US005163279A

United States Patent [19]

Stahlecker

[11] Patent Number: 5,163,279

[45] Date of Patent: Nov. 17, 1992

[54] ARRANGEMENT FOR PRODUCING FEEDING PACKAGES FOR A TWISTING OPERATION

[75] Inventor: Fritz Stahlecker, Bad Überkingen, Fed. Rep. of Germany

[73] Assignee: Hans Stahlecker, Fed. Rep. of Germany; a part interest

[21] Appl. No.: 780,456

[22] Filed: Oct. 22, 1991

Related U.S. Application Data

[63] Continuation of Ser. No. 483,715, Feb. 23, 1990, abandoned, which is a continuation-in-part of Ser. No. 311,731, Feb. 17, 1989, Pat. No. 4,947,633, which is a continuation-in-part of Ser. No. 361,321, Jun. 5, 1989, abandoned.

[30] Foreign Application Priority Data

Feb. 20, 1988 [DE] Fed. Rep. of Germany ..... 3805338
Jun. 10, 1988 [DE] Fed. Rep. of Germany ..... 3819858
Feb. 25, 1989 [DE] Fed. Rep. of Germany ..... 3905942

[51] Int. Cl.[5] ..... D01H 1/20; D01H 13/16

[52] U.S. Cl. ..... 57/86; 57/80; 57/261; 57/264

[58] Field of Search ..... 57/22, 261, 264, 80, 57/81, 86

[56] References Cited

U.S. PATENT DOCUMENTS

| | | | |
|---|---|---|---|
| 2,494,490 | 1/1950 | Rhinehart et al. | 57/86 |
| 3,367,813 | 2/1968 | Holdfeld | 57/22 X |
| 4,123,893 | 11/1978 | Chambley et al. | 57/204 |
| 4,219,998 | 9/1980 | Farnhill | 57/350 X |
| 4,356,688 | 11/1982 | Zurcher et al. | 57/22 |
| 4,389,837 | 6/1983 | Stahlecker et al. | 57/80 X |
| 4,404,791 | 9/1983 | Wolf et al. | 57/264 X |
| 4,444,005 | 4/1984 | Klein et al. | 57/81 |
| 4,466,236 | 8/1984 | Lagemann | 57/86 |
| 4,472,932 | 9/1984 | Guttler et al. | 57/86 X |
| 4,503,663 | 3/1985 | Horiuchi et al. | 57/261 |
| 4,620,413 | 11/1986 | Anahara et al. | 57/22 X |
| 4,656,822 | 4/1987 | Meissner et al. | 57/81 |
| 4,790,130 | 12/1988 | Stahlecker et al. | 57/328 X |
| 4,942,731 | 7/1990 | Morinashi et al. | 57/328 |
| 4,944,145 | 7/1990 | Stahlecker | 57/81 X |
| 4,947,633 | 8/1990 | Stahlecker | 57/80 X |
| 5,005,348 | 4/1991 | Stahlecker | 57/87 |
| 5,044,150 | 9/1991 | Stahlecker | 57/328 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In an arrangement for producing packages used as feeding packages for a subsequent twisting operation and containing two yarns wound up side-by-side, it is provided that the yarns are monitored with respect to a yarn breakage and, in the case of the occurrence of a yarn breakage, are cut and connected with one another at a common point before moving onto the package.

21 Claims, 3 Drawing Sheets

A
B
1
2
15
16
17
3
4
5
6
18
20
24
22
7
8
21
25
40
19
23
38
26
27
39
9
10
29
30
28
11
31
32
12
33
II
13
34
42
45
48
47
41
C
14
37
D
E
35
36

ARRANGEMENT FOR PRODUCING FEEDING PACKAGES FOR A TWISTING OPERATION

This is a continuation of application Ser. No. 07/483,715, filed Feb. 23, 1990 now abandoned. which is a Continuation-in-Part application of application Ser. No. 07/311,731 filed on Feb. 17 1989, now U.S. Pat. No. 4,947,663; and application Ser. No. 07/361,321, filed on Jun. 5, 1989, now abandoned.

BACKGROUND AND SUMMARY OF THE INVENTION

The invention relates to an arrangement for producing packages used as feeding packages for a subsequent twisting operation, these packages containing two prestrengthened yarns wound up side-by-side. The arrangement includes devices for the drawing of two slivers, devices for the prestrengthening of the slivers into yarns, devices for guiding the two yarns together to form a double yarn, devices for withdrawing the double yarn, devices for winding the double yarn onto a spool package and having devices for monitoring the two yarns with respect to a yarn breakage which are connected to a cutting device located in the path of the double yarn.

An arrangement of the initially mentioned type is the object of the above-mentioned application Ser. No. 07/311,731, corresponding to German Patent Application (P 38 05 338.1) , which is no prior publication. By means of this arrangement, the circumstance is taken into account that in the case of a breakage of only one of the yarns, it may occur that the two yarn ends are wound onto the spool at different points. It will then be difficult to find and pick up the yarn ends in such a manner that the double yarn can be withdrawn from the package for a piecing operation. By means of the cutting device, the double yarn is cut so that the yarn ends are located essentially at the same point on the package.

In the case of another process and another arrangement, which are the object of the above-mentioned application Ser. No. 07/361,321, corresponding to German Patent Application (P 38 19 858.4), which is no prior publication, it is provided that, in the case of a breakage of a yarn, the broken yarn end is connected with the unbroken yarn so that it is possible to withdraw the double yarn by means of the remaining not wound-up yarn after halting the spinning operation.

An object of the invention is to develop an arrangement of the initially mentioned type such that, in the case of a breakage of a yarn, the finding of the yarn ends and the withdrawing of the double yarn is possible in a still more reliable manner.

This object is achieved according to preferred embodiments of the invention in that devices are provided for connecting the two yarns in the area of the cutting point which are controlled as a function of the devices for monitoring the yarns with respect to a yarn breakage.

By means of this development, it is ensured that the yarns cut at the same point are, in fact, also located at the same point of the Package and are picked up together. As a result, it is avoided that the yarn ends, although they were cut together, are moved apart and wound up at separate points when moving onto the package for example, by means of the cross-winding device. In addition, it is avoided that only one of the yarn ends is picked up. As a result, it is ensured that, during a withdrawal, a double yarn is always withdrawn.

In a further development of the invention, it is provided that devices are provided for examining the quality of the double yarn, as a function of which the cutting device and the devices for the connecting are controlled. Thus, as early as during the producing of the packages used as feeding packages for a twisting operation, a monitoring of the quality becomes possible so that a rewinding of the twisted yarn for cleaning out any defects is not necessary in most cases.

In a further development of the invention, it is provided that the devices for the cutting of the double yarn and the devices for connecting the two yarns in the area of the cutting point are combined into a subassembly. In this case, in a further development of the invention, devices are provided in the area of the cutting point which have a combined cutting function for the double yarn and a connecting function for the yarns.

In a further development of the invention, it is provided that a melting device is provided as the device for the connecting which can be brought into the moving path of the double yarn. This type of a melting device results in a good connection of yarns which consist of synthetic fibers or have a proportion of synthetic fibers. In the case of this development, combined functions can easily be obtained by providing that the devices for the cutting contain a heating device for at least one cutting device. During a cutting, a melting will then take place simultaneously so that a connection of the two yarn ends is obtained.

In another development of the invention, a device for applying an adhesive or gluing agent on the double yarn is provided as the device for the connecting. In many cases, a paraffining device may be sufficient which causes an adhesive connection of the two yarn ends.

In another embodiment of the invention, a swirl nozzle situated in the moving path of the double yarn is provided as the device for the connecting. This swirl nozzle causes an intertwisting of the two yarns or even an intermingling of the fibers of the two yarns so that a joint yarn end is obtained.

In a further development of the invention, it is provided that the devices for examining the quality of the double yarn and the devices for monitoring the yarns with respect to a yarn breakage are connected to a device for interrupting the spinning operation and/or for separating the package from the wind-up device. As a result, in particular, a separating from the cross-winding device is carried out so that the jointly cut yarn ends, when moving onto the package, are not separated from one another.

Other objects, advantages and novel features of the present invention will become apparent from the following detailed description of the invention when considered in conjunction with the accompanying drawings.

DETAILED DESCRIPTION OF THE DRAWING

Figure 1:
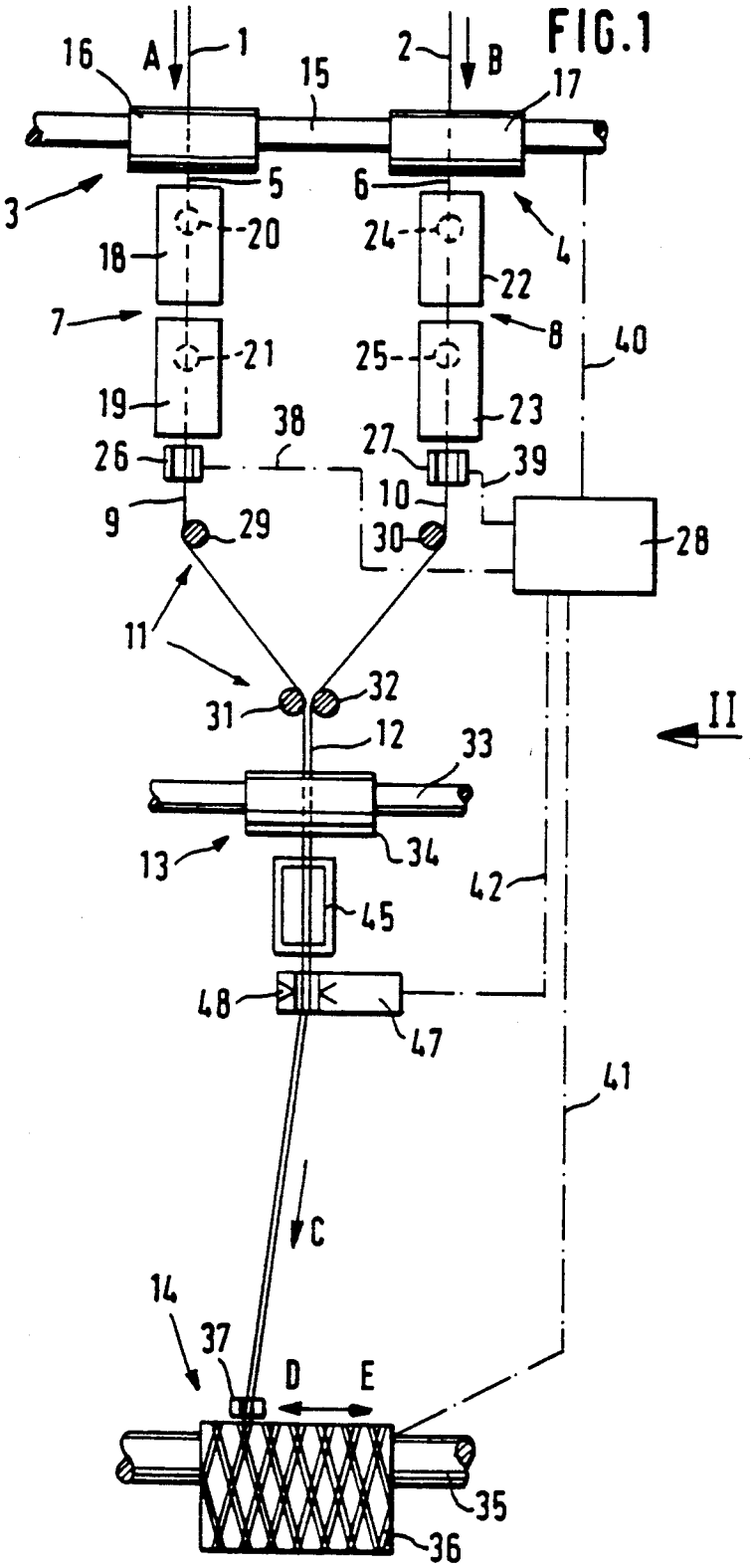
FIG. 1 is a front schematic view of an arrangement constructed according to a preferred embodiment of th invention.
Figure 2:
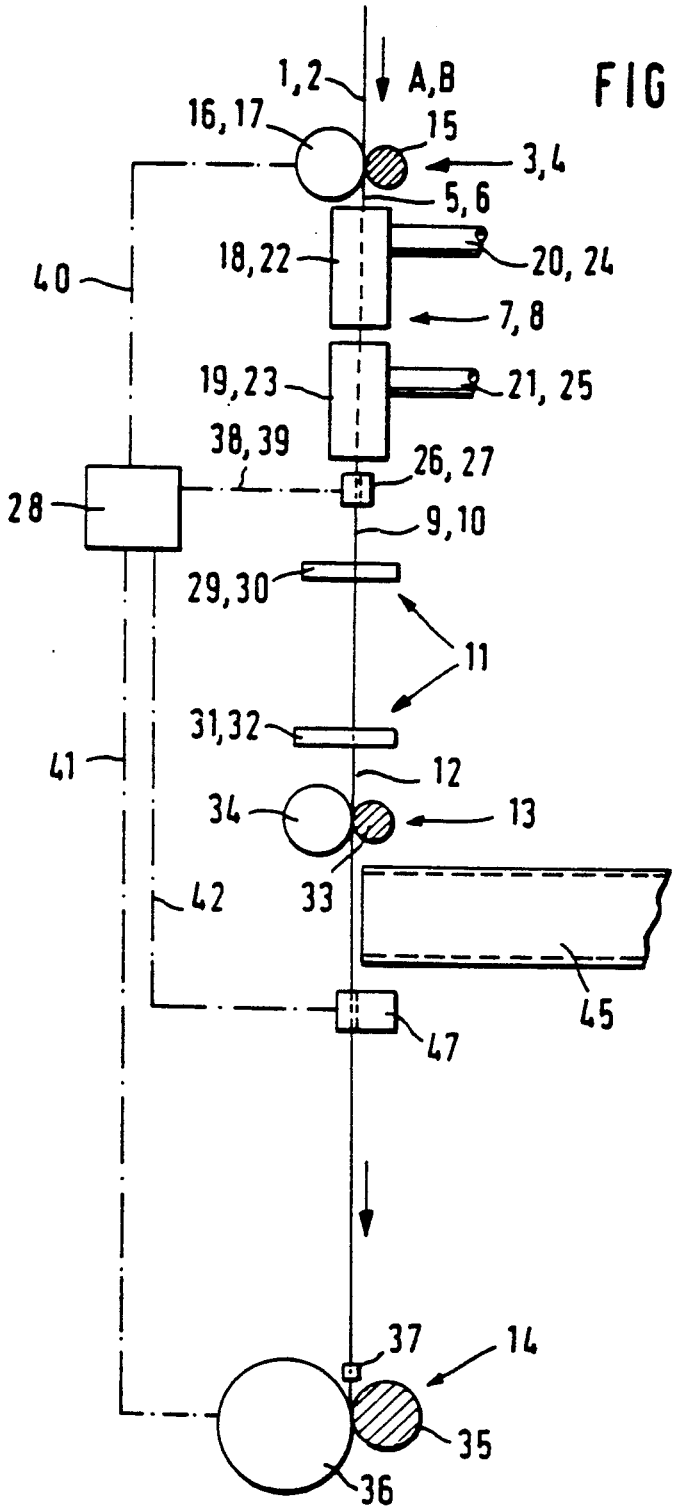
FIG. 2 is a view taken in the direction of Arrow II of FIG. 1.

FIGS. 1 and 2 show an individual spinning point of a spinning machine which has a plurality of spinning points of this type arranged in a row next to one another. At each of these spinning points, two slivers 1, 2 move in the direction of the arrows (A and B) through the drafting units 3, 4 in which they are drawn to yarn components 5, 6 of the desired yarn size. These yarn components 5, 6 move into pneumatic false-twisting devices 7, 8 in which they are spun into only relatively slightly prestrengthened yarns 9, 10. Behind the false-twisting devices 7, 8 the yarns 9, 10 are guided together by means of yarn guiding elements 11 to form a double yarn 12 which is withdrawn by a common withdrawal device 13. Subsequently, the double yarn 12 moves in the direction of arrow (C) to a wind-up device 14 where it is wound side-by-side onto a cross-wound package 36.

Of the drafting units 3, 4, only the pair of delivery rollers is shown which is formed by and by pressure rollers 16, 17 and a bottom cylinder 15 extend through in the longitudinal direction of the machine and driven at the machine end and. Like the other pressure rollers of the preceding roller pairs, the pressure rollers 16, 17 are constructed as so-called Pressure roller twins which are held in a loading arm which is not shown. The drafting units 3, 4 are adapted to the fiber material to be spun and may be constructed, for example, as three-cylinder drafting units or as five-cylinder drafting units. These drafting units contain apron guides which are not shown. It is possible to interrupt the operation of the drafting units 3, 4 at an individual spinning point, for example, by lifting off the loading arm with the pressure rollers or by using known sliver stopping devices.

The pneumatic false-twisting devices 7, 8 each contain two air nozzles 18, 19; 22, 23 arranged behind one another which are connected to compressed-air supply pipes 20, 21, 24 25. The respective first air nozzles 18, 22 are constructed as so-called intake nozzles which provide the entering yarn components 5, 6 with no or almost no false twist. The respective second air nozzles 19, 23 are constructed as false-twisting nozzles which provide the yarn components with a false twist. After the opening-up of the false twist, several fiber ends remain wound around the essentially untwisted yarn connection, whereby the yarn components 5, 6 are now prestrengthened into yarns 9, 10. The prestrengthening is advanced only so far that the yarns 9, 10 have a sufficient strength for further handling. However, because of their insufficient strength, they cannot be used as individual yarns.

Directly following the outlet of the air nozzles 19, 23 constructed as false-twisting nozzles, two yarn detectors 26, 27 are arranged which monitor the yarns 9, 10 with respect to a yarn breakage. These yarn detectors 26, 27 are connected to a control apparatus 28 which, when a yarn breakage is detected, triggers certain operations which will be explained in the following.

Pin-type yarn guides 29, 30, 31, 32 are provided as yarn guiding elements 11 which hold the yarns 9, 10 first as an extension of the air nozzles 19, 23, and subsequently guide them together to form the double yarn 12. The yarn guides 31, 32 maintain a distance from one another which is dimensioned such that the yarns 9, 10 of the double yarn 12 are disposed closely next to one another, but are nevertheless held separate from one another.

As the withdrawal device 13, a cylinder 33 is used which extends through in the longitudinal direction of the machine and is driven at the machine end, a pressure roller 34 being assigned to this cylinder 33 at each spinning point.

The wind-up device 14 is shown only very schematically. It contains a winding shaft 35 which extends through in the longitudinal direction of the machine and is driven at a machine end The package 36, which is held by a spool frame, which is not shown, rests on this winding shaft 35 and is driven by the winding roller 35 to perform the wind-up movement. The wind-up device 14 also contains a cross-winding device of which only a cross-winding yarn guide 37 is shown. This cross-winding yarn guide 37 can be moved in the direction of the arrows (D and E) in such a manner that the double yarn 12 is wound up into a cross-wound package 36.

Between the withdrawal device 13 and the wind-up device 14, a yarn testing device 47 is arranged for the monitoring of the quality of the double yarn 12. A suction device 45 is also disposed between the yarn testing device 47 and the withdrawal device 13.

The yarn testing device 47, by means of a line 42, is connected to the control apparatus 28, to which the yarn detectors 26, 27 are connected by means of lines 38, 29. The control apparatus 28 is also connected to the devices for stopping the drafting units 3, 4, which are not shown, by means of a line 40 which is only outlined. In addition, a line 41 connects the control apparatus 28 with a device, which is not shown, for lifting the package 36 off the winding roller 35, in which case, in particular, also the double yarn 12 is lifted out of the cross-winding yarn guide 37. During this lifting-off, the package 36 swivels together with its spool frame which is not shown.

In the embodiment according to FIGS. 1 and 2, the yarn testing device 47 is constructed as a combined device which not only carries out a monitoring of the yarn quality, but also a cutting of the double yarn 12, in which case, the yarn ends, are simultaneously at least partially connected with one another by these devices 48 for cutting. These devices 48 for the cutting are triggered not only by the yarn testing device 47 but also by the yarn detectors 26, 27 by means of the control apparatus 28. This monitoring of the yarn quality during which yarn defects are detected which are no longer tolerable for a future twisted yarn, has the result that a later rewinding operation for a twisting operation will not be necessary particularly in cases in which the piecing of the double yarn 12 withdrawn again from the package 36 to the newly spun yarns 9, 10 takes place in such a manner that a yarn-like connection is created, particularly a spliced connection by means of a splicing device.

The devices 48 for the cutting contain, for example, scissor-type arranged blades of which at least one can be swivelled toward the other, by means of a solenoid, and which normally are kept apart by means of a spring. These devices 48 for cutting the double yarn 12 may be constructed such that they cut the yarns 9, 10 only partially and otherwise pinch them off so that the yarn ends remain adhered to one another. In another embodiment, the devices 48 for the cutting are provided with a heating device so that, during a cutting, a melting-together of synthetic fibers of the double yarn 12 takes place and thus also a connecting of the yarn ends.

When a yarn breakage is determined by means of the yarn detectors 26, 27, just as in the case of the determination of a yarn defect by means of the yarn testing device 47, an interruption of the spinning operation is carried out by means of the control apparatus 28 by making the drafting units 3, 4 inoperative and by lifting off the package 36. By lifting the package 36 off the winding shaft 35, it is prevented that the double yarn end produced by the devices 48 for the cutting is rolled into the surface of the package 36.

Figure 3:
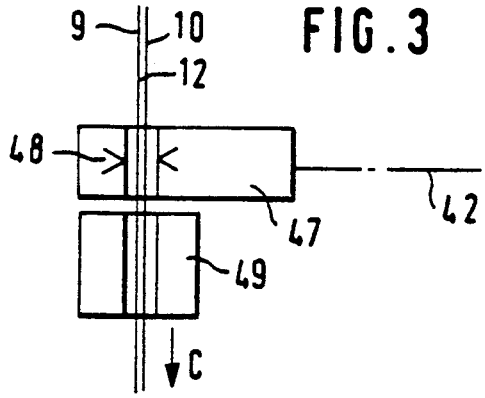
FIG. 3 is a detail of an arrangement corresponding to FIG. 1 and 2, having a device for connecting the yarn ends.
Figure 4:
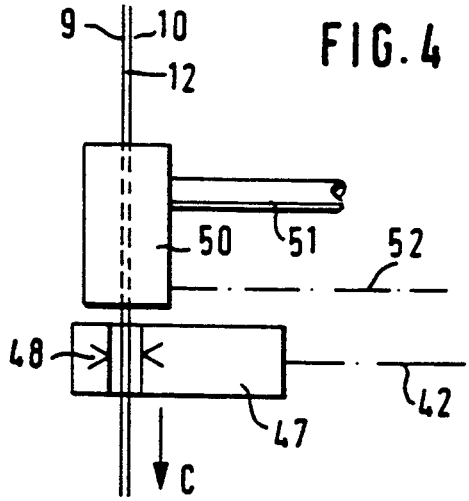
FIG. 4 is a detail similar to FIG. 3 with a modified device for connecting the yarn ends.

The devices 48 for the cutting of the double yarn 12 may also be separated from the devices for connecting the yarns 9, 10 in the area of the separating point, as shown in FIGS. 3 and 4. In the embodiment according to FIG. 3, a device 49 for connecting the yarn ends is connected behind the yarn testing device 47 which is combined with the devices 48 for the cutting. This device 49 may, for example, be a paraffining device or a device for the spraying-on of an adhesive or gluing agent or also a compressing device or a mechanical rubbing mechanism or the like. This device 49 is selected as a function of the fiber material. Under certain circumstances, it is sufficient in the case of yarns 9, 10 made of cotton fibers if only a moistening with water or the like takes place.

In the embodiment according to FIG. 4, a device 50 for connecting the double yarn 12 is connected in front of the yarn testing device 47 which is equipped with devices 48 for the separating, particularly for the cutting, of the double yarn 12. This device 50 is, for example, a swirl nozzle connected to a compressed-air feeding line which can be operated by means of a line 52, controlled by the control apparatus 28. In this case, the device 50 is naturally operated before the devices 48 for the cutting.

During a subsequent yarn piecing, such a length of the double yarn 12 wound onto the package 36 is wound off and cut off that the connected yarn ends and also the defective point determined by the yarn testing device 47 are definitely eliminated.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for producing feeding packages containing two yarns wound up side-by-side as a double yarn for a subsequent twisting operation, said apparatus comprising:

drafting means for drafting two slivers, prestrengthening means arranged downstream of said drafting means and including means to form two separate prestrengthened yarn components from the respective slivers, yarn guide means for guiding the yarn components disposed in side-by-side relationship, withdrawing means for withdrawing the double yarn from the yarn guide means, winding means for winding the double yarn supplied by the withdrawing means onto a spool package, cutting means for cutting the two yarn components at a similar position along the length thereof, connecting means for connecting the cut yarn end portions preliminary to their being wound onto the spool package by the winding means, and monitoring means for monitoring the two yarn components with respect to yarn quality deterioration, said monitoring means being operable to signal operation of the cutting means and the connecting means in response to detection of unacceptable quality of one of the yarn components, wherein said cutting means is disposed downstream of the monitoring means to thereby assure simultaneous cutting of the two yarn components at the similar position with resulting disposition of cut ends of both yarn components at a common location on the spool package.

2. Apparatus according to claim 1, wherein said monitoring means includes yarn breakage monitoring means for monitoring the two yarn components with respect to a yarn breakage, said monitoring means being operable to signal operation of the cutting means and the connecting means in response to breakage of one of the yarn components.

3. Apparatus according to claim 2, wherein said monitoring means includes yarn quality testing means for testing the quality of the double yarn, said monitoring means being operable to signal operation of the cutting means and the connecting means in response to said yarn quality testing means determining unacceptable quality of the double yarn.

4. Apparatus according to claim 3, wherein said yarn quality testing means is disposed downstream of the yarn breakage monitoring means in the travel path of the yarn components.

5. Apparatus according to claim 3, wherein the cutting means and connecting means are combined into a single device disposed between the yarn guide means and the winding means.

6. Apparatus according to claim 3, wherein the connecting means includes a yarn melting means for melting at least portions of the yarn components.

7. Apparatus according to claim 3, wherein the cutting means includes a heating device for heating at least one of the yarn components.

8. Apparatus according to claim 3, wherein the connecting means includes a device for applying adhesive material to the yarn components.

9. Apparatus according to claim 3, wherein the connecting means includes an air swirl nozzle disposed along the travel path of the double yarn.

10. Apparatus according to claim 3, wherein said prestrengthening means includes at least one pneumatic nozzle for applying twisting forces to each of the yarn components.

11. Apparatus according to claim 1, wherein said monitoring means includes yarn quality testing means for testing the quality of the double yarn, said monitoring means being operable to signal operation of the cutting means and the connecting means in response to said yarn quality testing means determining unacceptable quality of the double yarn.

12. Apparatus according to claim 11, wherein the cutting means and connecting means are combined into a single device disposed between the yarn guide means and the winding means.

13. Apparatus according to claim 1, wherein the cutting means and connecting means are combined into a single device disposed between the yarn guide means and the winding means.

14. Apparatus according to claim 1, wherein the connecting means includes a yarn melting means for melting at least portions of the yarn components.

15. Apparatus according to claim 1, wherein the cutting means includes a heating device for heating at least one of the yarn components.

16. Apparatus according to claim 1, wherein the connecting means includes a device for applying adhesive material to the yarn components.

17. Apparatus according to claim 1, wherein the connecting means includes an air swirl nozzle disposed along the travel path of the double yarn.

18. Apparatus according to claim 1, comprising a spinning interruption device for interrupting operation of the prestrengthening means, wherein said monitoring means is operable to signal actuation of the spinning interruption device.

19. Apparatus according to claim 18, comprising package separating means for separating the package from the winding means, wherein said monitoring means is operable to signal actuation of the package separating means.

20. Apparatus according to claim 1, comprising package separating means for separating the package from the winding means, wherein said monitoring means is operable to signal actual of the package separating means.

21. Apparatus according to claim 1, wherein said prestrengthening means includes at least one pneumatic nozzle for applying twisting forces to each of the yarn components.

* * * * *